United States Patent [19]

Baker

[11] 4,020,852

[45] May 3, 1977

[54] APPARATUS FOR APPLYING UNITING BANDS TO CO-AXIAL ROD-SHAPED ARTICLES

[75] Inventor: Max Norris Baker, Rural Hall, N.C.

[73] Assignee: R. J. Reynolds Tobacco Company, Winston-Salem, N.C.

[22] Filed: July 7, 1976

[21] Appl. No.: 703,155

[52] U.S. Cl. ..... 131/94

[51] Int. Cl.[2] ..... A24C 5/48

[58] Field of Search ..... 131/88, 94, 95, 21

[56] References Cited

UNITED STATES PATENTS

| | | | |
|---|---|---|---|
| 3,001,528 | 9/1961 | Schubert | 131/94 |
| 3,506,017 | 4/1970 | Schubert | 131/94 |
| 3,526,233 | 9/1970 | McArthur | 131/94 |
| 3,527,234 | 9/1970 | Hinzmann | 131/94 |
| 3,665,930 | 5/1972 | Giatti | 131/94 X |

*Primary Examiner*—Stephen C. Pellegrino
*Attorney, Agent, or Firm*—Grover M. Myers

[57] ABSTRACT

An improved apparatus for applying uniting bands around a group of co-axial rod-shaped articles including a rolling drum with raised pockets, a second rolling surface to engage the articles and cause them to be rolled between the raised pockets, and a vacuum system to hold the articles as they are placed on the rolling drum.

1 Claim, 6 Drawing Figures

APPARATUS FOR APPLYING UNITING BANDS TO CO-AXIAL ROD-SHAPED ARTICLES

BACKGROUND OF THE INVENTION

The present invention relates to an apparatus for joining two abutting rod-shaped articles by convoluting a uniting band around their juncture. In particular, this invention relates to a device for applying an adhesive-coated band of tipping or similar paper around two co-axial rod-shaped articles which constitute a filter rod and tobacco rod.

There are several types of devices known in the prior art which are used to assemble a filter rod and a tobacco rod together by a uniting band. Although these devices have been used for many years and are still used in some instances, there are numerous difficulties with their operation which cause a considerable amount of downtime for an assembly machine.

One of the assembly apparatus used includes a roll drum which has a plurality of raised pockets around its periphery. Normally, as the roll drum is rotated in a counterclockwise direction, a double filter rod and tobacco rod abutting each end of the filter rod are placed on the rear side of the raised pockets as the pockets pass near a transfer drum. While on the transfer drum, a tipping band or flag which has an adhesive coating is secured at one point to the outer surface of the filter so that, when transfer to the roll drum is made, the flag will be in contact with the surface of the roll drum. The roll drum has vacuum ports between the raised pockets to hold the flag against the drum.

Immediately adjacent the transfer point and contiguous to the surface of the roll drum is a rolling hand or plate which contacts the periphery of the filter and tobacco rods, causing them to roll in the direction opposite the direction of rotation of the roll drum. The rods are rolled by the hand slightly more than one revolution so that the tipping band overlaps and the double cigarette formed will rest against the forward side of the adjacent trailing raised pocket. The double filter cigarette then passes under a guide rail adjacent the surface of the drum which holds the double cigarette on the drum until transferred.

It has ben found that the major problems with this type of rolling apparatus is the inability to purge the system of bad work (cigarettes which have burst, misaligned rods at transfer, and trash such as paper, adhesive and tobacco) because the roll hand engages the rods immediately adjacent transfer. The positive contact of the rods by the raised pockets and roll hand at transfer cause the misaligned rods and bad work to be carried around the drum and, oftentimes, jam-ups are caused. Loose tobacco, paper, adhesive and other substances used in forming the ciagrettes tend to build up on the roll hand causing the gap or spacing from the drum to be changed. Since this spacing is very critical to properly form the cigarettes, it becomes necessary to clean the roll hand frequently and reset the proper gap.

To overcome this problem, the above-described rolling apparatus was modified and this modification is disclosed in U.S. Pat. No. 3,527,234. Basically, the modified device utilizes a roll drum with a shallow recessed pocket having a vacuum holding system. This device differs from the first described device in that the roll blocks or hand is spaced from the point of transfer and the vacuum system exclusively is used to transfer and hold the rods to the roll drum. The spacing between the roll block and the transfer point and the exclusive use of the vacuum to hold the work on the drum provide an area where bad work, misaligned cigarettes, etc. can be purged from the roll drum. For example, if the rods are severely misaligned and the vacuum will not pick them up, they will fall off the drum into an appropriate receptacle. Furthermore, by eliminating the roll hand adjacent the transfer point so trash can be purged from the system, there is not trash build-up problem which removes the cause of the improperly formed cigarettes.

While this above-described modification may have eliminated some problems, it produced others. First, since there is no positive control of the rods at transfer, rods which are only slightly misaligned will ofentimes be held on the drum by the vacuum system, causing jam-ups to occur in front of the rolling block. In this particular modification, a switch has been located just prior to the roll block to arrest the machine if a jam should occur. This solution is unacceptable because, each time the machine is shut down, hundreds of properly formed cigarettes are rejected upon restart.

The device disclosed in U.S. Pat. No. 3,527,234 also has an elongated roll block (multi-roll block) whereby the rods are rolled several times. The purpose of the multi-roll was to provide more time for the tipping to adhere to the rods. In order to accomplish this multi-roll, the pockets of the roll drum had to be recessed rather than raised so that the rods can move between several pockets under the roll block. It has been found that the recessed pockets do not provide sufficient control over the cigarettes under the roll block, therefore, they can easily become misaligned. For this reason, a repositioning wheel is required after the rolling block to realign the cigarettes in the pockets. On occasion, the cigarettes become so misaligned that they become crosswise on the drum and the realignment wheel will not realign them so they are not captured in the vacuumized pockets of the drum and will fall off the drum, producing another jam-up possibility.

It has also been found that, because of the recessed pockets, a greater positive pressure has to be placed on the filter and tobacco rods to start them rolling and keep them rolling between pockets. This increased pressure changes the firmness of the filter and the tobacco rod, thus, changing the draft characteristics of the filter and contributing to an already substantial loose end problem (loosely packed tobacco at the end of the tobacco rod).

SUMMARY OF THE INVENTION

It is, therefore, an object of this invention to provide an improved apparatus for convoluting bands around rod-shaped articles.

Another object of this invention is to provide an apparatus for convoluting bands around rod-shaped articles which has an area in which bad work and misaligned articles may be purged from the system before applying the band.

Another object of this invention is to provide an apparatus for convoluting bands around rod-shaped articles in which positive control of the alignment of the rod-shaped articles is retained throughout the process.

Another object of this invention is to provide a filter cigarette assembler which will not modify the draft characteristics of the filter rod during the assembly process.

Another object of this invention is to provide a filter cigarette assembler in which the loose end problem is reduced.

Still another object of this invention is to provide a filter cigarette assembler which will reduce jam-ups because of the ability to purge bad work and misaligned cigarettes from the system and because of the retention of positive control over the work.

These and other objects are accomplished by the present invention through the use of a rolling drum having a plurality of raised pockets spaced around its periphery. Each pocket receives a filter with a tipping band attached thereto and a tobacco rod abutting the filter. The drum is provided with a vacuum holding system for the pockets whereby the filter and tobacco are held on the drum upon transfer from the transfer drum. A roll block which is positioned adjacent the surface of the drum and spaced angularly from the point of transfer engages the rods and rolls them one revolution to convolute the tipping band about the rods, thus, moving the rods so that they engage the forward side of the next adjacent raised pocket. A guide rail is provided adjacent the end of the roll block to hold the formed filter cigarettes on the roll drum until they are transferred to another drum.

BRIEF DESCRIPTION OF THE DRAWINGS

The foregoing and additional objects, features and advantages of the invention will be apparent to those skilled in the art from the following detailed description of a preferred embodiment, taken with the accompanying drawings, in which.

DESCRIPTION OF THE PRIOR ART

Figure 1:
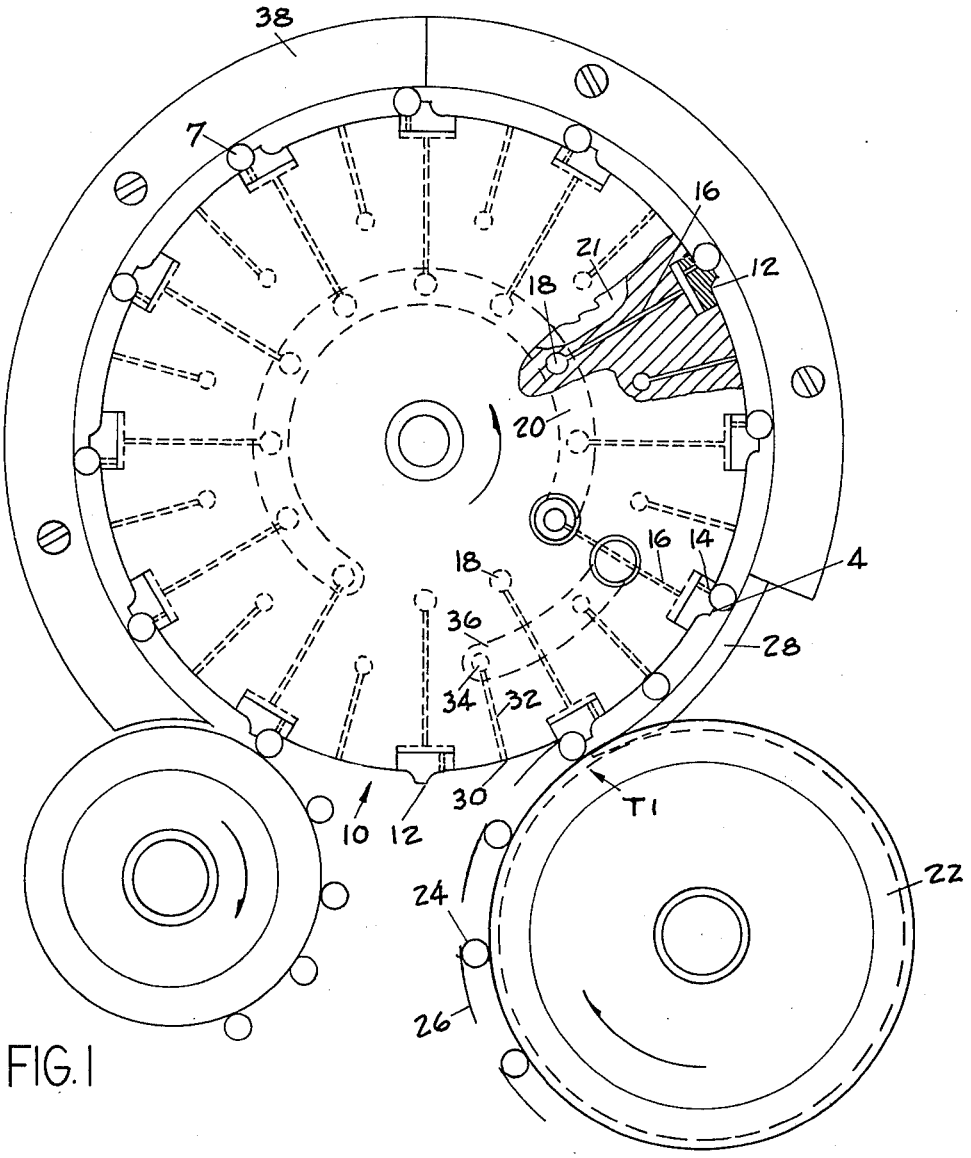
FIG. 1 is a front view of one embodiment of the roll and transfer drums of the filter cigarette assembler previously known in the art.
Figure 2:
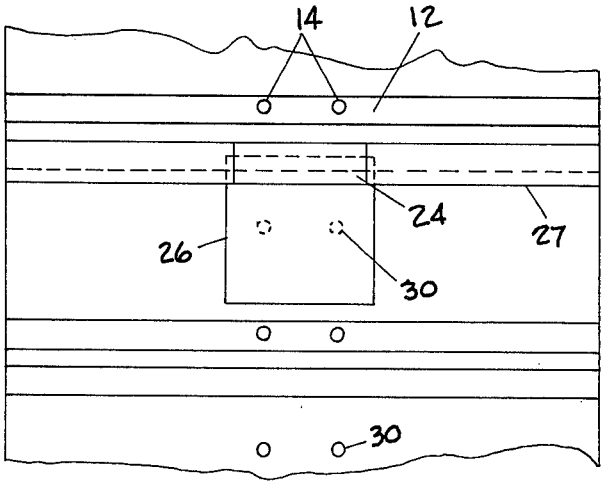
PRIOR ART FIG. 2
FIG. 2 is a plan view of a portion of the roll drum detailing a raised pocket carried on the drum surface.

In FIG. 1, the numeral 10 indicates a drum conveyor or rolling drum having a plurality of raised pockets 12 equally spaced around its peripheral surface. The raised pockets 12 (see FIG. 2) have two vacuum ports 14 located near the center of their forward side. The forward side being the left-hand side and rear side being on the righthand side of the pockets viewing a pocket at the twelve o'clock position on the drum. The pockets are connected through radial passages 16 to a bore 18 which is spaced from the axis of the drum and parallel thereto. The bore 18 communicates with an arc-shaped groove 20 in an air control ring 21 which, in turn, communicates with a vacuum source (not shown). The construction the use of air control rings are well known in the cigarette making machinery art.

A transfer drum 22 having a plurality of recessed pockets is positioned adjacent the roll drum 10 and carries in each pocket a double filter rod 24 with a tipping band 26 or flag attached to its surface and a tobacco rod 27 at each end of the filter. As each recessed pocket reaches a transfer point T1, the rods on the transfer drum are transferred to the rear side of the raised pockets 12 on the roll drum 10 with the aid of a rolling hand 28. The rolling drum 10 has a second set of ports 30 in the drum surface which communicate through a second radial passage 32 and axial bore 34 to an arc-shaped groove 36 in the air control ring 21. The ports 30 are provided to hold the tipping band against the surface of the drum at transfer (see FIG. 1).

As the transfer of the rods is made, the rolling hand 28 engages the filter and tobacco rods causing them to roll in a clockwise direction with respect to the surface of the roll drum, thus, convoluting the tipping band 26 around the filter and tobacco rods to form a double filter cigarette (a double length filter with a tobacco rod attached to each end). The double cigarette will be rolled to the forward side of the next adjacent raised pocket. As the double cigarette emerges from under the rolling hand 28, it passes under a hold down guide rail 38 which is spaced from and circumscribes the surface of the drum 10. As the double cigarettes emerge from the hand 28, the bore 18 which communicates with vacuum port 14 passes into groove 20 of the control ring 21, thereby providing a suction to aid the hold down rails in holding the double cigarette on the drum. As can be seen in the drawings, no space has been provided between the transfer point T1 and the rolling hand 28 to permit bad work, misaligned rods or trash to be purged from the system.

Figure 3:
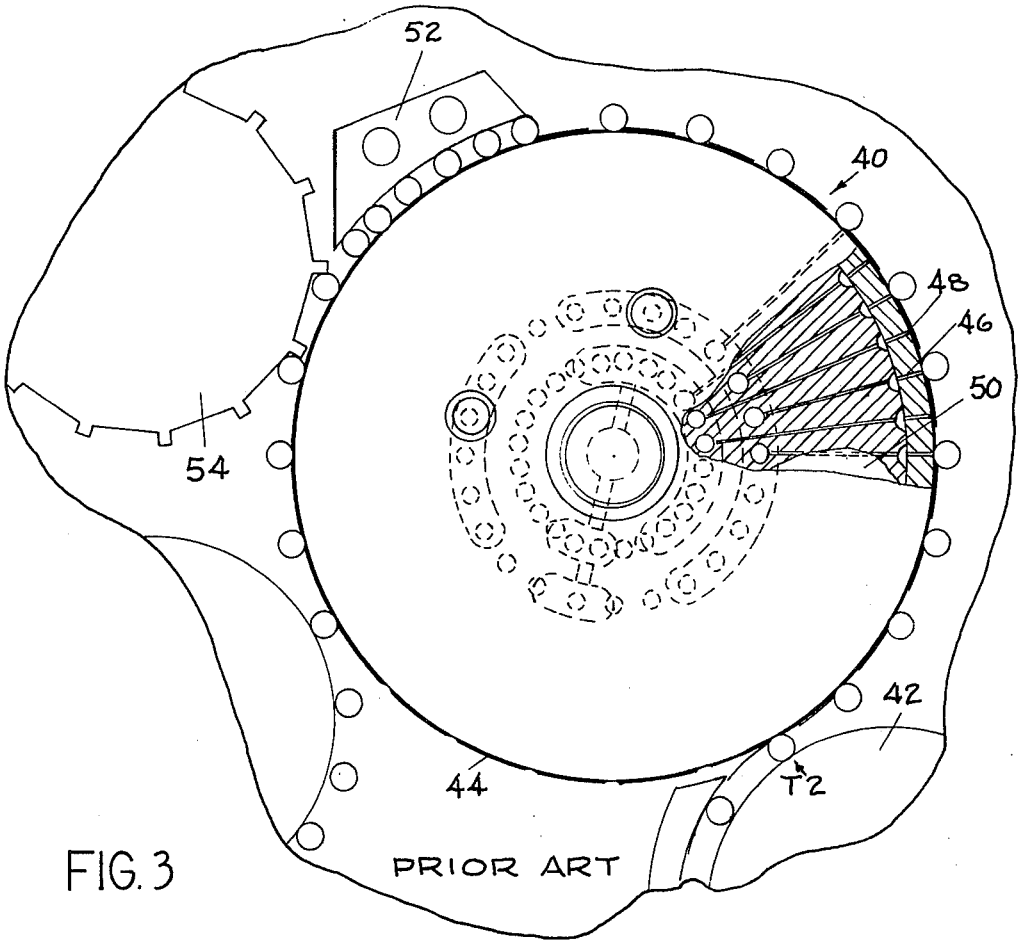
FIG. 3 is a front view of another embodiment of the roll and transfer drums of a filter cigarette assembler previously known in the art.

In FIG. 3 there is illustrated a second prior art device which was designed to perform an area to permit bad work, misaligned rods and trash to be purged from the system. This device includes a roll drum 40 and transfer drum 42. The roll drum has a plurality of shallow, recessed pockets 44 equally spaced around its peripheral surface. The filter rods with their associated tipping bands and the tobacco rods are transferred from the drum 42 at T2 to the recessed pockets on the roll drum. As can be seen, the roll drum includes a vacuum pick-up system with vacuum ports 46 in the recessed pockets 44 to hold the filter and tobacco rods on the drum. Additional ports 48 in the drum are provided to hold the tipping band against the face of the drum. The vacuum is controlled by an air control ring 50 as is known in the art. Spaced angularly around the drum 40 from the transfer point T2 is a multiroll block 52 which engages the rods causing the attached band to be convoluted around the rods. The length of the multi-roll block and the absence of raised pockets permits the rods to be rolled several revolutions under the roll block. Upon exiting from under the multi-roll block, the formed double cigarettes are usually not aligned with the pockets, thus, a wheel 54 is provided to realign or reposition the double cigarettes in the pockets. The double ciagarettes ae again held on the drum by the vacuum system.

As mentioned previously, although this multi-roll device provides an area to purge misaligned rods and bad work from the drum, there are other problems which are produced by this embodiment which can cause considerable downtime for the system. For example, the recessed pockets do not provide the positive control over the rods at the transfer point T2, thus, more misalignment occurs which is, in some cases, purged between transfer and the rolling block, but in other instances will stay on the drum and cause jam-ups at the roll block 52. Normally, a switch (not shown) is provided at this point to arrest the machine. However, each time the machine is arrested, several hundred properly formed cigarettes are rejected upon restart.

The multi-roll block 52 produces modification in the draft characteristics of the filter because more pressure must be applied to remove the filters from the recessed pockets. The added pressure necessary to start the rods rolling causes the tobacco filler in the tobacco rod to become loose, thus, adding to an already substantially loose end problem.

DESCRIPTION OF A PREFERRED EMBODIMENT OF THE INVENTION

Figure 6:
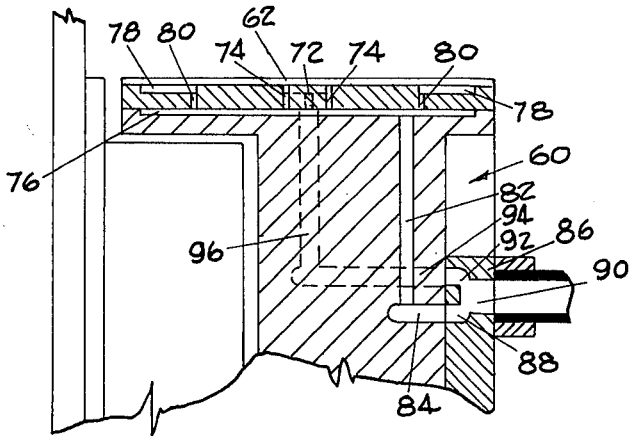
FIG. 6 is a cross section view taken along line 6—6 of FIG. 4.
Figure 4:
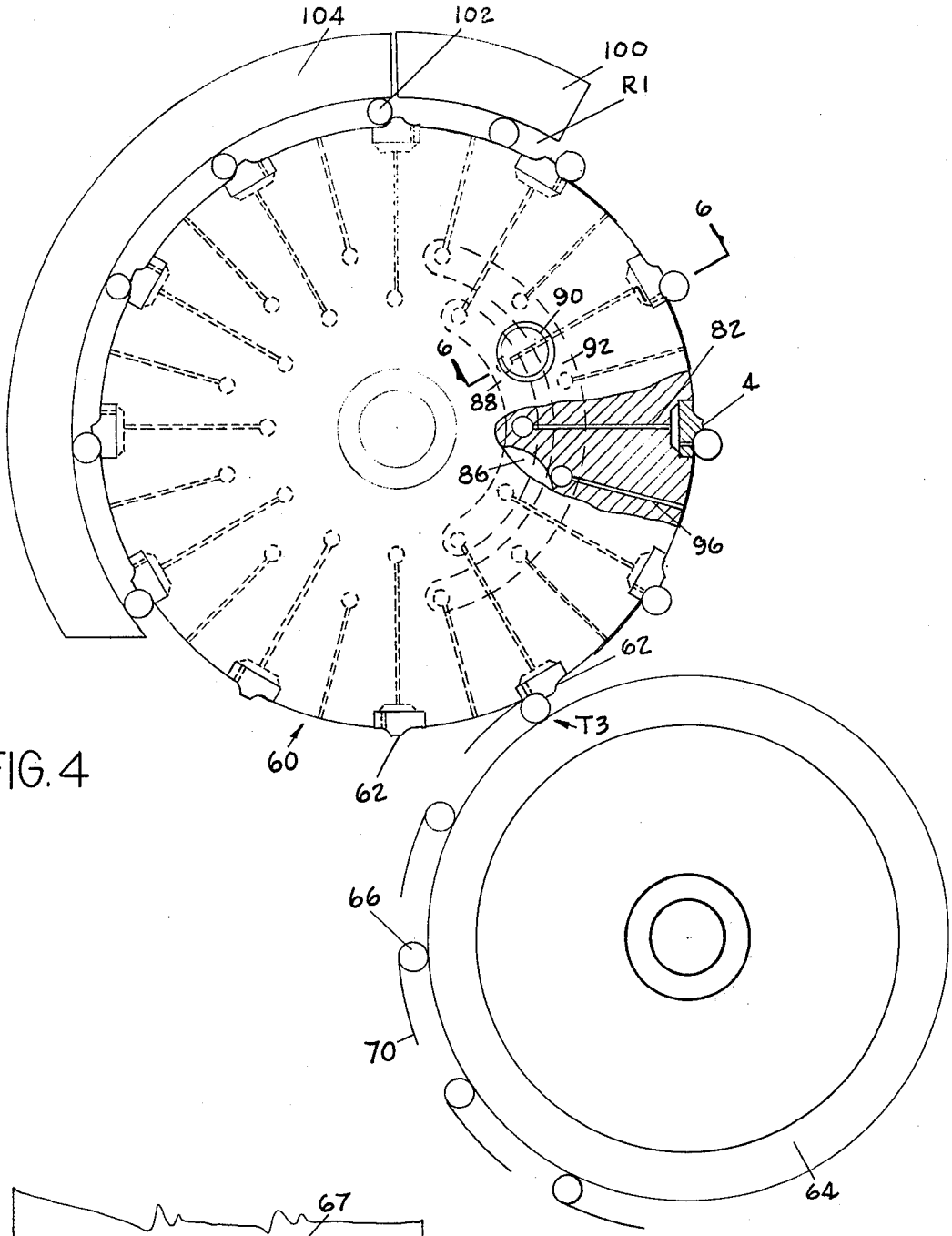
FIG. 4 is a front view of the roll and transfer drums of a filter cigarette assembler according to the present invention.
Figure 5:
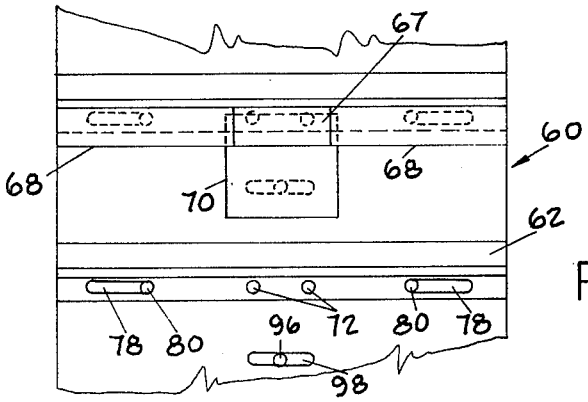
FIG. 5 is a plan view of a portion of the surface of the roll drum showing a portion of raised pockets according to the present invention and illustrating the arrangement of the various vacuum ports in the pocket.

The problems of the prior art device mentioned above are remedied by the improved roll device illustrated in FIGS. 4 through 6. In FIG. 4, the numeral 60 indicates a roll drum having a plurality of raised pockets 62 equally spaced around the peripheral surface of the drum. The roll drum is positioned adjacent to a transfer drum 64 which carries a rod assembly 66, including a double filter 67 and tobacco rods 68 abutting each end of the filter (see FIG. 5). The filter 67 has a tipping band or flag 70 attached at one point to its outer surface away from the surface of the transfer drum.

As rod assemblies 66 on the surface of the transfer drum pass adjacent to the surface of the roll drum 60, they are transferred at T3 to the rear side of the raised pocket 62 and held in place by a vacuum or suction system. The vacuum system has two ports 72 near the center of each raised pocket having bores or ducts 74 (see FIGS. 5 and 6) which extend through the raised pocket and communicate with the surface groove 76 on the surface of the roll drum. Outwardly towards each edge of the pockets are elongated grooves 78 which communicate with groove 76 through bores 80.

Extending radially inwardly through the drum 60 from the surface groove 76 is a bore or duct 82 which terminates in an axial bore 84 which is spaced from the axis of the drum and parallel thereto. Adjacent the drum 60 is an air control ring 86 which includes an arc-shaped groove 88 that communicates through passage 90 to a vacuum source (not shown). A second arc-shaped groove 92 is provided in the control ring 86 and communicates with the passage 90 and with a second axial bore 94 in the drum 60. The axial bore 94 communicates with a radial bore 96 which exits on the surface of the drum in an elongated groove 98.

As can be seen in FIG. 4, the arc-shaped grooves 88 and 92 begin slightly prior to the transfer point T3 and extend in a counterclockwise direction to a point slightly beyond the point R1 at the beginning of the roll block 100.

At the transfer point T3, the rod assembly comes in contact with raised pocket and is transferred to the roll drum and held there by the suction being exerted thereon through the vacuum pockets 72 and 80. The tipping band 70 is held against the surface of the drum due to the suction applied through port 96. As the rod assemblies move around the drum towards the roll block 100, there is an opportunity for bad work and trash to be purged because the rolling operation takes place at an angular distance from the transfer point, thus, there is no rolling hand or guide rail holding the rod assemblies on the drum as is the case in the first described prior art device. Furthermore, with the raised pockets, there is more positive control over the alignment of the rods, thus, the misalignment problem which exits with the second described prior art device is substantially reduced.

When the rod assemblies 66 contact the forward edge of the roll block 100, they begin rolling in a clockwise direction to convolute the band around the abutting rods. Only one revolution can be accomplished with the roll block 100 because of the raised pockets. Furthermore, very little pressure is required to start the rods rolling and continue to keep them rolling; therefore, the draft characteristics of the filters are not changed. With only one revolution, the overlap area of the tipping always ends up next to the drum surface and the heat from the drum aids in curing the adhesive. The formed double cigarette filters 102 contact the forward side of the raised pockets as they pass from under the roll block and are carried on the roll drum to exit point E1. A guide rail 104 is spaced from the surface of the drum and begins near the end of the roll block to hold the double cigarettes on the drum unaided by a vacuum hold. The guide rail in a raised pocket provides positive control over the double cigarettes until the exit point. They also cooperate to carry the bad work around the drum, thus, preventing jam-ups that often occur when such positive control is not used. The bad work is normally rejected by an inspection drum at a later time.

It can be seen from the above description of the preferred embodiment that the present invention provides an improved apparatus for convoluting bands around rod-shaped articles. It also provides an area where misaligned rods, bad work and trash may be purged from the system before rolling. The device further gives positive control over the rod assemblies and will not modify the draft characteristics of the filter. Reduction in the loose end problem and less downtime for eliminating jams is also an advantage of the present device.

The above-described preferred embodiment can be modified in various ways as would be apparent from the foregoing. For example, the routing of the vacuum passages can be varied and the configuration and mounting of the roll drum. However, these and other variations and changes of a similar nature can be made to the invention as abovedescribed and illustrated without departing from the true spirit and scope thereof as defined in the following claims.

I claim:

1. An improved apparatus for applying uniting bands around successive groups of co-axial rod-shaped articles comprising:

a. a rolling drum having a plurality of successive raised pockets equally spaced around the peripheral surface of the drum and parallel to the axis of the drum;

b. drive means for rotating said rolling drum;

c. a transfer drum for supplying to the rolling drum at a selected transfer point assemblies of co-axial articles and uniting bands in a pre-determined position on the rear side of the raised pockets;

d. a second roll surface spaced a selected distance in the direction of the rolling drum rotation from the transfer point to permit bad work to be purged from the drum, said second roll surface being positioned adjacent the rolling drum surface to provide a gap slightly less than the diameter of the rods to cause the assemblies to roll in a direction opposite the direction of rotation of the rolling drum to thereby convolute the uniting bands around the respective articles, the sizes of said gap being sufficient to permit said raised pockets to pass, said second roll surface being of such length that the assemblies will roll only one revolution and move between the rear side of one raised pocket to the forward side of the trailing raised pocket;

e. suction ducts in the rear side of said raised pockets.

f. means for applying a vacuum to said suction ducts from the transfer point to the beginning of said second roll surface; and g. a rail circumscribing the rolling drum from the end of the second roll surface to an exit point, said rail holding the assembled groups on the rolling drum.

* * * * *